US005673441A

United States Patent [19]

Wang

[11] Patent Number: 5,673,441

[45] Date of Patent: Oct. 7, 1997

[54] FLUSH VALVE FOR TOILETS

[76] Inventor: Chih Chiang Wang, 2F., No. 3, Lane 280, Chung-Chan Rd.,Hsin Tien Cith, Taipei Hsien, Taiwan

[21] Appl. No.: 653,879

[22] Filed: May 28, 1996

[51] Int. Cl.[6] ..... E03D 1/34

[52] U.S. Cl. ..... 4/378; 4/379; 4/388; 4/324

[58] Field of Search ..... 4/378, 379, 380, 4/388, 324, 327

[56] References Cited

U.S. PATENT DOCUMENTS 3,964,109 6/1976 Street et al. ..... 4/327
4,160,294 7/1979 Crumby ..... 4/324

*Primary Examiner*—David J. Walczak

*Attorney, Agent, or Firm*—Pro-Techtor International

[57] ABSTRACT

A flush valve of a toilet that includes an internal valve piece and an external valve piece. The external valve piece is circular and is installed inside a circular hole which includes a circular flange that engages the internal valve piece. A rear side of the internal valve piece includes a resilient portion formed from gelatinous material so that the internal valve piece serves the purpose of delaying the reset action. Basically, in the first stage the flush handle is rotated by the user to open the internal valve piece. Thus, the drain rate of the water box is slower. In the second stage, the flush handle further is rotated to a position to engage the internal circular flange of the external valve piece so as to open the external valve piece. Therefore, the drain rate becomes much faster. By the two stage flushing process, the user can regulate the drain rate, thus conserving water.

2 Claims, 4 Drawing Sheets

FLUSH VALVE FOR TOILETS

FIELD OF INVENTION

The present invention is related to a flush valve for a toilet, and in particular the valve includes an internal valve piece and an external valve piece which form a two stage construction.

BACKGROUND OF THE INVENTION

In general, toilets waste a great deal of water in houses. For present art toilets there is generally no control means for regulating the volume of water use for a flush. People often put bottles or bricks in the water tank to save water. However, this introduces the disadvantages that the volume of saved water is smaller, and the toilet bowl many not be cleaned completely.

Therefore, there are many water saving means on the market. Generally, the process is divided into several stages and a drain means in installed to control volume. Generally, the architecture of said means is complex and the cost is high.

SUMMARY OF THE INVENTION

Accordingly, the object of the present invention is to improve the construction of the flush valve piece adaptable to all kinds of water tanks and is easy for user to install. By the function of the two stage valve, the object of saving water is attained.

Another object of the present invention is to control the volume of flush water by the delay and restored functions of the present invention. The control means only includes an internal valve piece and an external valve piece eliminating complexity of the control means.

The present invention is a flush valve of a toilet that includes an internal valve piece and an external valve piece. The external valve piece is circular and is installed inside a circular hole which includes a circular flange that engages the internal valve piece. A rear side of the internal valve piece includes a resilient portion formed from gelatinous material so that the internal valve piece serves the purpose of delaying the reset action. Basically, in the first stage the flush handle is rotated by the user to open the internal valve piece. Thus, the drain rate of the water box is slower. In the second stage, the flush handle further is rotated to a position to engage the internal circular flange of the external valve piece so as to open the external valve piece. Therefore, the drain rate becomes much faster. By the two stage flushing process, the user can regulate the drain rate, thus conserving water.

Other features and advantages of the present invention will become apparent from the following description of the preferred embodiments of the present invention which refers to the accompanying drawings.

DETAILED DESCRIPTION OF THE PREFERRED EMBODIMENT

Figure 1:
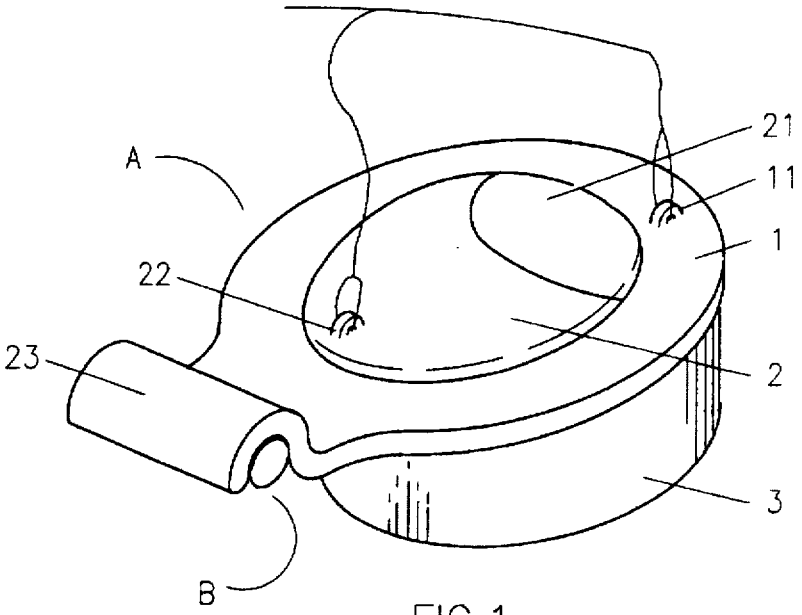
FIG. 1 is a perspective view of the valve of the present invention.
Figure 2:
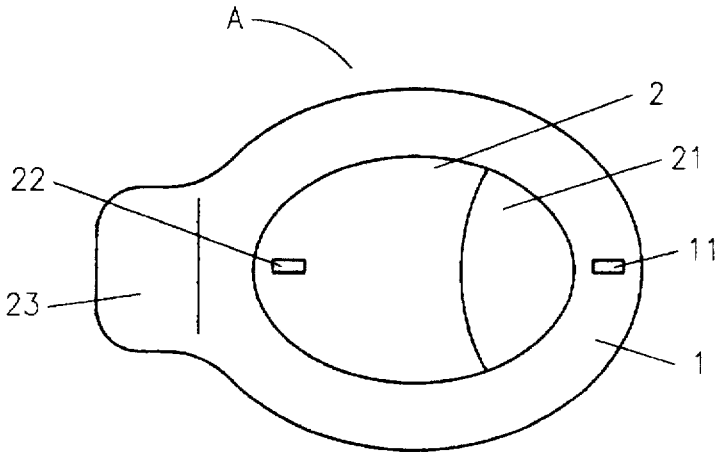
FIG. 2 is a top view of the present invention.
Figure 3:
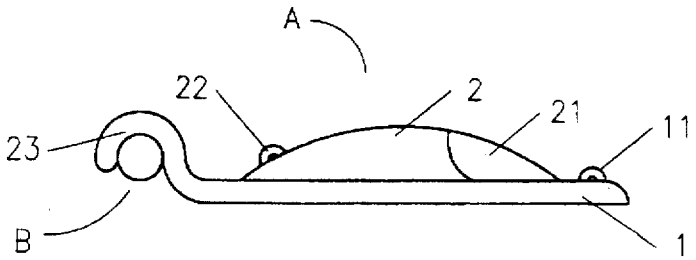
FIG. 3 is a side view of the present invention.
Figure 4:
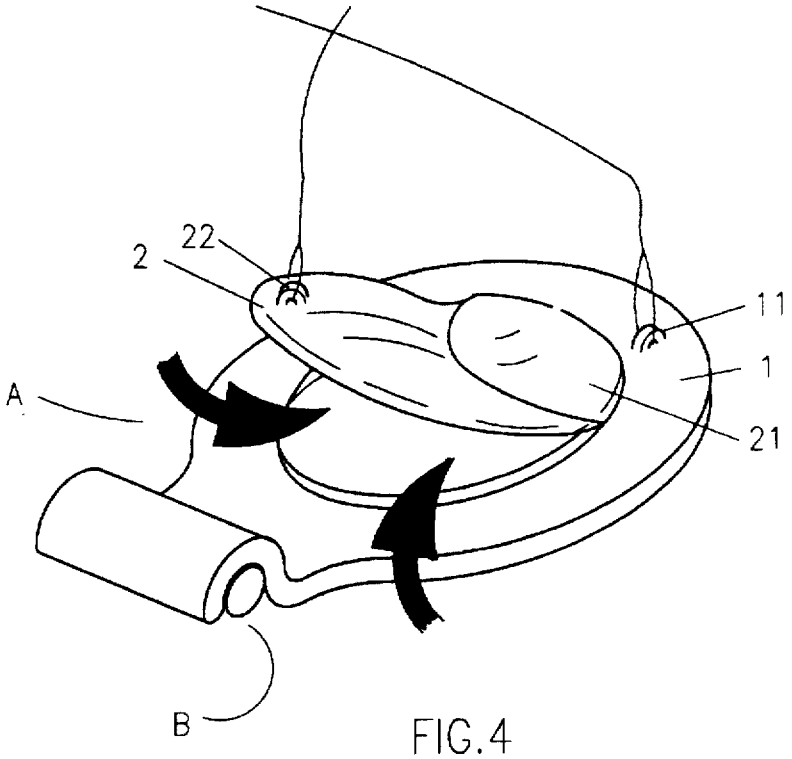
FIG. 4 shows the first stage of the valve opening.

Referring first to FIGS. 1 to 3, the valve of the present invention are installed on the opening of the drain pipe 3 in the water tank of a toilet. The valve A is mounted on a fixed axle by an axle base in the rear thereof.

The valve A comprises an internal valve piece 2 and an external valve piece 1. The external valve piece 1 is circular and is mounted inside a circular hole which includes a flange for engaging the internal valve piece 2. A rear portion of the internal valve piece 2 includes a resilient portion 21 formed from gelatinous material. The resilient portion 21 serves as a hinge so that the internal valve piece has the function of delaying the reset action (which will be described below).

The opening end of the internal valve piece 2 is opposite that of other external valve piece. Eyelets 22 and 11 are installed respectively in the internal valve piece 2 and the external valve piece 1.

Figure 5:
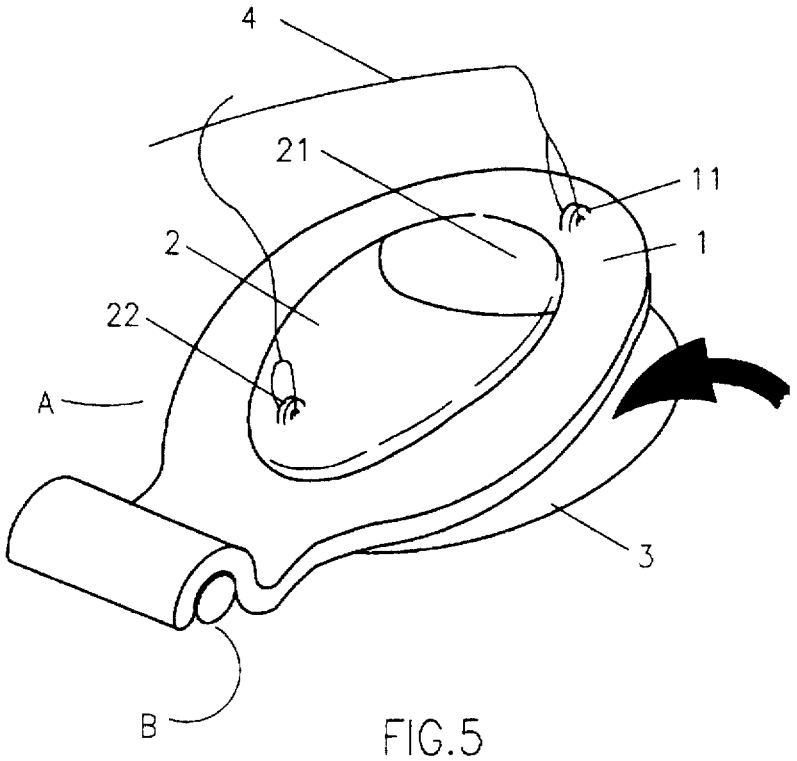
FIG. 5 shows the second stage of the valve opening.
Figure 6:
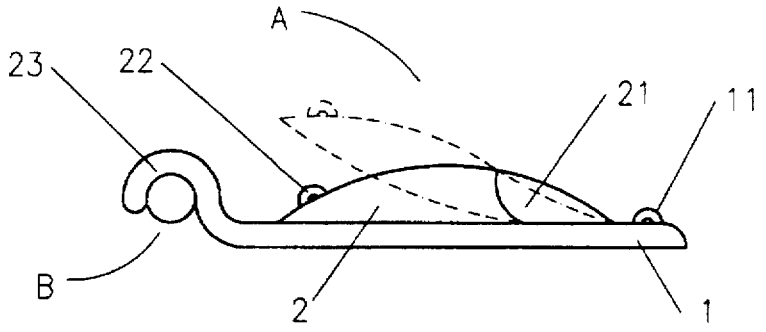
FIG. 6 shows the two positions of the inner valve piece.
Figure 8:
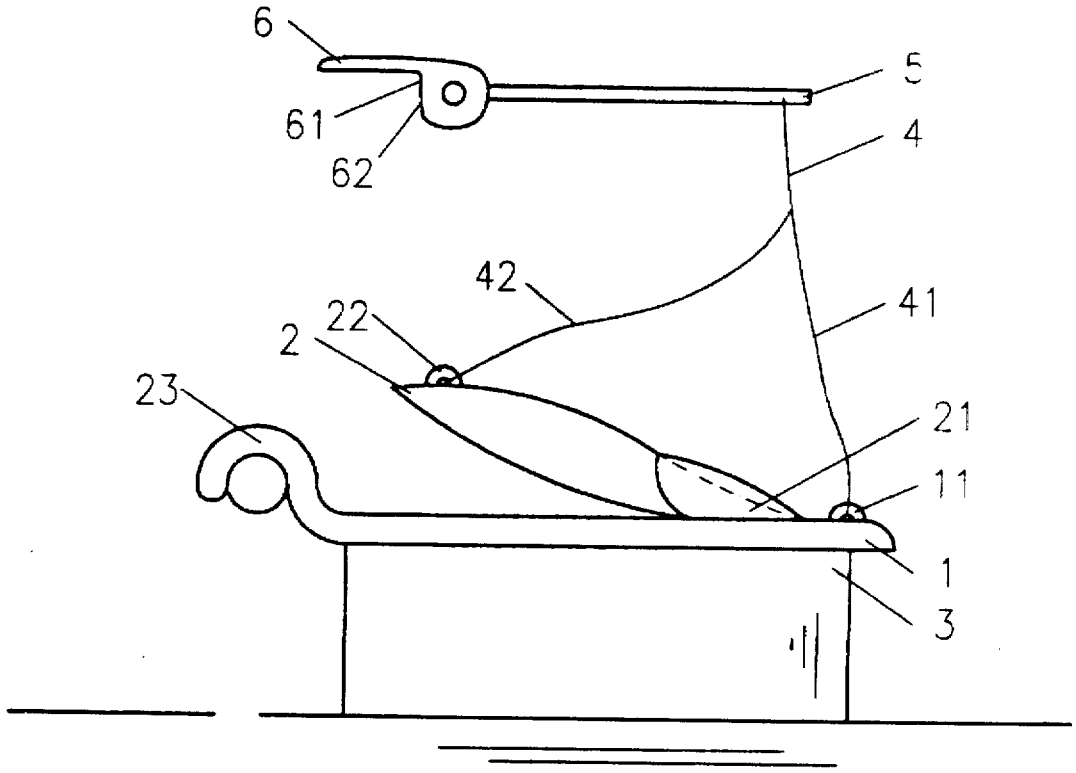
FIG. 8 is the schematic view showing the linkage construction between the valve and the flush handle.

Shown in FIG. 8 is a schematic view of the present invention. FIG. 8 shows the structure within the water tank of the present invention. As shown in FIG. 8, the flush valve A is used to seal the opening of the drain pipe 3 in the interior of the water tank. The eyelets are pulled by using a short pull rope 42 and a long pull rope 41. The connecting rod 5 is connected to a two stage handle 6. Basically, in the first stage the handle is rotated by the user to open the internal valve piece 2 as shown in FIGS. 2 and 6. The drain rate of the water box is fairly slow. In the second stage, the handle is rotated further by the user, which opens the external valve piece 1 as shown in FIG. 5. The drain rate therefore becomes much faster. By the two stage flushing process, the user can regulate the drain rate properly, thus conserving water.

Figure 7:
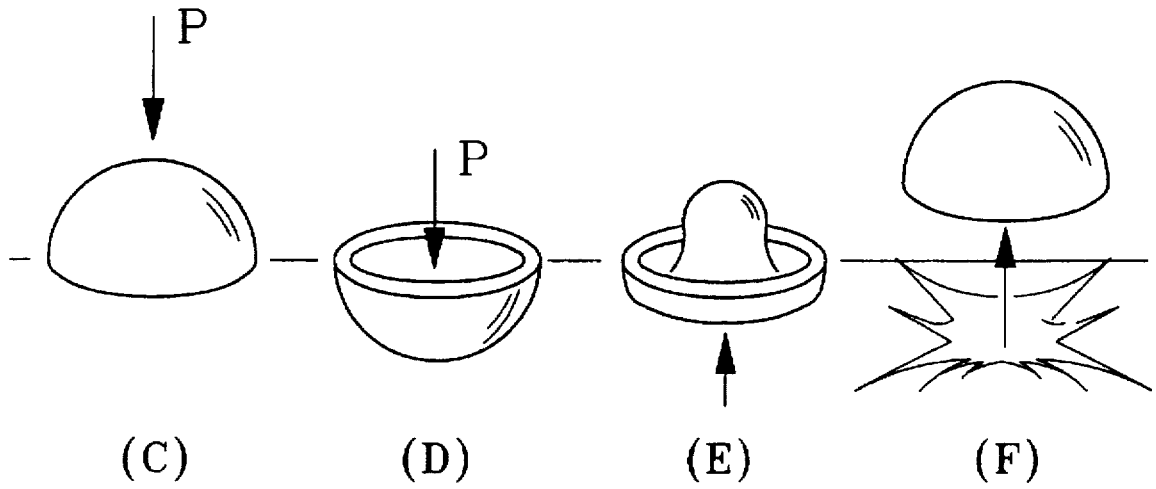
FIG. 7 illustrates the resiliency of the gelatinous material.

FIG. 7 shows the properties of the resilient portion of the present invention. As shown in FIG. 7, the resilient portion is formed by gelatinous material of high flexibility. If a external pressure P is applied on the gelatinous material (C), the opposite side (D) will be deformed. If the external pressure P is released, (E), the opposite side will be restored to the original shape (F) (after a few minutes). Just as the opposite side is restored to its original shape, if it is put on a flat surface the body will rebound as indicated by (F) in FIG. 7. This causes the inner valve piece to properly engage with the inner flange of the external valve piece 1.

From another aspect, after opening the valve piece in the first stage and before opening in the second stage, there is a delay time of several seconds for the internal valve piece 2 to drain away the water from the toilet until the body restores to its original shape, or the external valve piece is opened. By using the internal valve piece 2, the external valve piece 1, and the resilient portion 21 of the present invention described hereinbefore, the effect of the two stages flush is achieved with a simple construction.

Although the present invention has been described in relation to a particular embodiment, thereof, many other variations and modifications and other usages will become apparent to those skilled in the art. Therefore, the present invention is not limited by the specific disclosure herein.

I claim:

1. A flush valve for a toilet comprising:

an internal valve piece and an external valve piece, said external valve piece includes a flange, said flange receives said internal valve piece, a rear side of said internal valve piece includes a resilient portion formed from gelatinous material such that a resetting action of said internal valve is delayed after said internal valve is opened, thereby creating a two-stage flushing process wherein:

in a first stage, a flush handle of said toilet is rotated to open said internal valve piece, thereby initiating a draining of water from a water tank of said toilet, and upon further rotation of said flush handle, a second flush stage is initiated by opening said external valve piece, thereby greatly increasing a flow rate of said water from said water tank, said external valve piece being closed when said user releases said flush handle, and a closing of said interior valve piece being delayed by a tendency of said resilient portion to remain in an open position.

2. The flush valve for a toilet as defined in claim 1 wherein:

said internal valve piece and said external valve piece are connected to said flush handle by means of a combination of pull ropes.

* * * * *